United States Patent [19]

Sanz

[11] 4,129,900

[45] Dec. 12, 1978

[54] APPARATUS FOR LIGHTING WITH FLUORESCENT TUBES OF AUTOMATIC FIXING AND CONNECTION

[76] Inventor: Eduardo P. Sanz, Avenida de Pablo Gargallo, 46-48 (Sector Quimica), Zaragoza, Spain

[21] Appl. No.: 771,648

[22] Filed: Feb. 24, 1977

[30] Foreign Application Priority Data

Feb. 24, 1976 [ES] Spain ..... 219042

[51] Int. Cl.[2] ..... H05B 33/02; F21V 21/08

[52] U.S. Cl. ..... 362/217; 362/226

[58] Field of Search ..... 240/51.11 R, 52.1, 52 R, 240/53; 362/217, 220, 226, 260, 368, 457

[56] References Cited

U.S. PATENT DOCUMENTS

| | | | |
|---|---|---|---|
| 2,335,218 | 11/1943 | Vacha | 362/221 |
| 2,563,146 | 8/1951 | Wise | 240/51.11 R |
| 3,070,689 | 12/1962 | McIntosh | 240/51.11 R |
| 3,109,598 | 11/1963 | Morgan | 362/226 |
| 3,673,402 | 6/1972 | Weiss | 240/51.11 R |

*Primary Examiner*—J. D. Miller
*Assistant Examiner*—Peter S. Wong
*Attorney, Agent, or Firm*—Blanchard, Flynn, Thiel, Boutell & Tanis

[57] ABSTRACT

A fluorescent lighting fixture having an elongated housing with a pair of side flanges. The housing is adapted to be disposed in a first orientation wherein same opens upwardly for mounting on a ceiling, and is adapted to be mounted in a second orientation wherein it opens downwardly. A pair of lamp holders are slidably disposed within the housing adjacent the opposite ends thereof. A pair of end covers are receivable within the opposite ends of the housing, which lamp holders and covers coact with the opposite side flanges for holding the covers and lamp holders on the housing. The covers and lamp holders are inverted relative to the housing when the latter is converted for use from the first orientation to the second orientation, and vice versa. A pair of mounting racks are adapted to be secured to the ceiling for releasably supporting the housing when the latter is in the first orientation. Each mounting rack includes a pair of lugs spring urged outwardly in opposite directions and having camming means on the outer ends thereof adapted for engagement with the housing flanges. The lugs have electrical contacts positioned for engaging electrical contacts mounted on the inside of the flanges.

1 Claim, 23 Drawing Figures

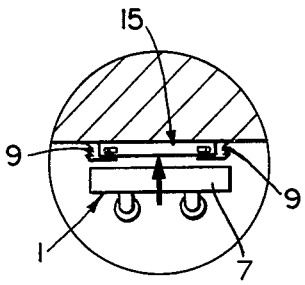
FIG. 6A
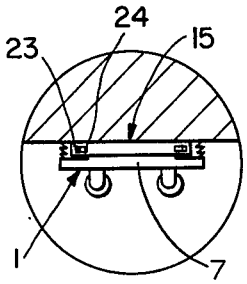
FIG. 6B
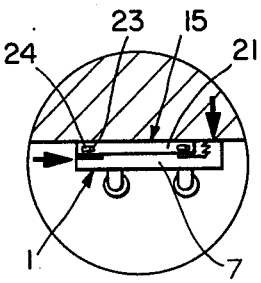
FIG. 6C
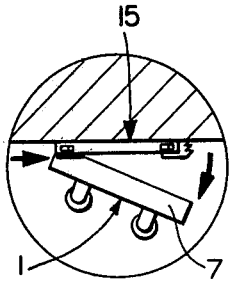
FIG. 6D
FIG. 8A
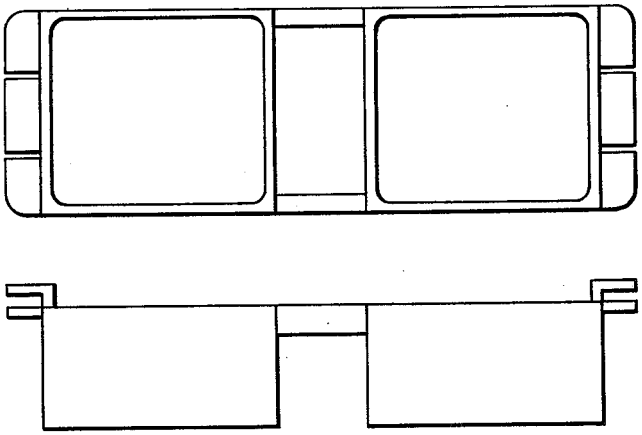
FIG. 8B
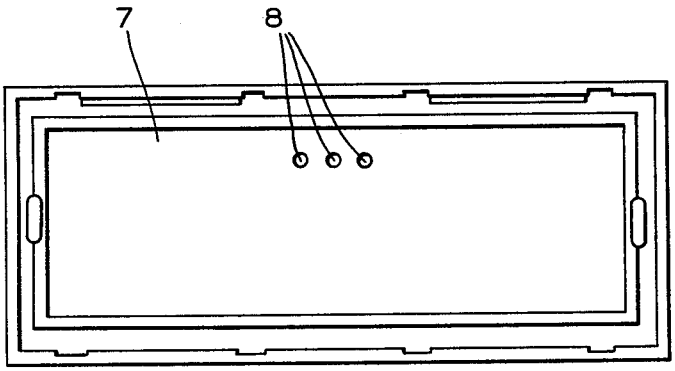
FIG. 9A
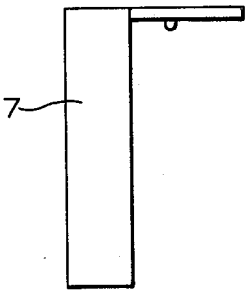
FIG. 9B FIG. 10A
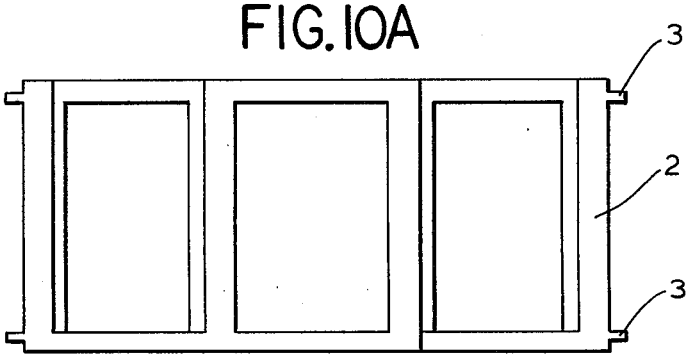
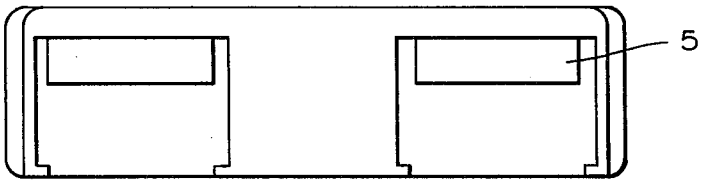
FIG. 10B
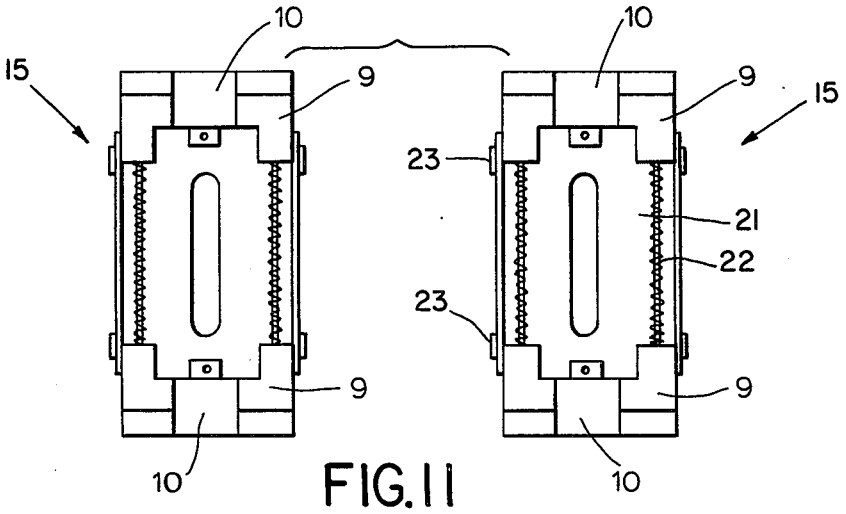
FIG. 11

FIG.15A
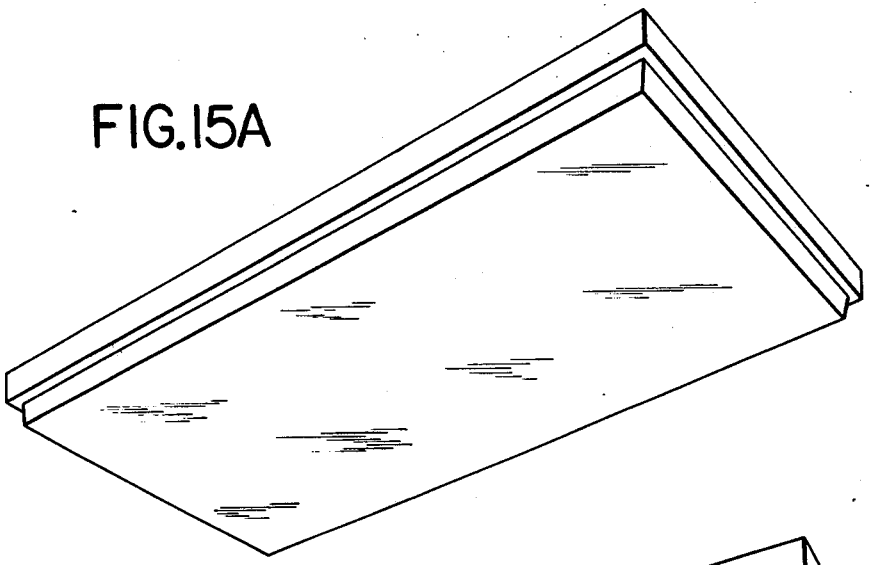
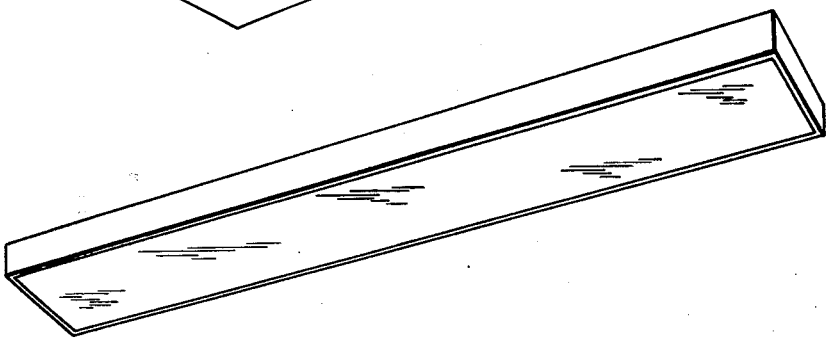
FIG.15B

APPARATUS FOR LIGHTING WITH FLUORESCENT TUBES OF AUTOMATIC FIXING AND CONNECTION

DESCRIPTIVE REPORT

The invention relates to an apparatus for lighting with fluorescent tubes, its design and assembly characteristics having been brought to a degree of perfection which enables it to carry out perfectly the function for which it has been created.

The apparatus presented here possesses certain exceptional novelties, such as its system of connection to the feed network and, as well, the ground connection if necessary, which is automatically obtained at the same time as its fixing on its corresponding miniracks, providing, of course, that the apparatus is used as a strip fixed to the ceiling or wall.

When it is necessary to use the apparatus mentioned as an industrial shade modulus, this can be achieved by means of the reversal of its side covers and of its inner plastic slides relative to the channellike strip so that the apparatus enjoys a double possibility with regard to its use, carrying out the simple operation indicated.

In the previously mentioned case (that is to say, when the apparatus is used as a strip fixed to the ceiling or wall), its fixing and automatic connection to the network being obtained, this by mounting the strip on the two parts which we call automatic miniracks, which are previously fixed to the ceiling by traditional means: screws, adjustable threaded hooks, etc.

These automatic miniracks are constituted by a "U" shape base on the flanges of which there are two extended openings for freely guiding two pairs of guide lugs belonging to two parts situated between both flanges which slide along the inside of the "U" and on the bottom of the base. These pieces of plastic, bakelite, porcelain, steatite insulating material, etc., are operated by springs of a suitable type in the sense of separation, on the upper parts of which a pair of parallel ribs has been produced, in the form of lineal teeth on which the apparatus will be fixed, carrying out in its turn the outlet of the same automatically, as we have stated previously, as there exist, duly coupled to the teeth or ribs of the isolating parts of the miniracks, electrical contacts of brass, copper, aluminum, etc., which coincide with the electrical contact plates which exist coupled in the interior of the apparatus at both ends and longitudinally. These contact plates, duly insulated in their support of the metallic profile of the apparatus, will be connected to the different electric service elements which constitute the inner installation of the group. The feed wires of the network and, as well, the ground connection of the electric installation, if there were one, will have to be connected to the contacts of the miniracks according to the sketch accompanying each apparatus, once these have been fixed to the ceiling or to the wall.

The connection of wires to the contacts of the interior plates of the apparatus, which may be of brass, copper, aluminum, etc., can be carried out with FASTON or similar connectors or traditional screws or any other pressure system or, if preferred, soldered. The connections of the wires of the electric feed installation to the contacts of the miniracks will be carried out in accordance with the system which the manufacturer of the assembly prefers to use, either with screws or with pressure springs or parts, etc.

Another feature of this assembly is that it possesses a starter holder support which may be made of plastic, rubber or of any other flexible material and which is placed in position as a slide thanks to parallel ribs which slide along the flanges of the metallic profile of the apparatus. This system contributes the advantage of it being possible to pressure receive any type of starter holder of standard measurements and which should never be varied as regards position even though the apparatus be used in one way or another, another advantage being the quickness of its mounting process as it does not require either springs or screws for fixing.

Other features of the group or model are those represented by two slides of plastic or other material which are included with each apparatus and which slide along the inside of the latter, being provided with ribs which make a stop on the metallic flanges of the profile which constitutes the apparatus. These inner slides offer the feature of lodging or receiving the lamp holders which are included with the model. The normal lamp holders of any manufacturer can be adapted with the new type of slides providing that these maintain on their base standardized measurements and possess a suitable pressure anchoring system for the same. The unquestionable advantage of these slides which have been previously mentioned consists in that, besides being able to receive the lamp holders, registering them perfectly so as to avoid them being displaced and their contacts failing, they can be inverted as regards position, which possibility provides the advantage of being able to transform the automatic strip apparatus in a modulus or complement of perfected industrial apparatus, for which it is absolutely necessary to invert, too, the position of the side covers of the ends of the apparatus, which are provided with inner ribs which couple by pressure simply and which possess orifices or holes through which the feed wires come out, which join the service network by means of an automatic connection plug or traditional system.

It is understood that when the apparatus of the invention is used as a modulus or complement of industrial equipment, it is not necessary to use the automatic miniracks, but the interior contact plates will be used as from them the outlet wires to the feed network and, as well, the ground connection wire or conductor, if necessary, will start off.

Once the position of the interior slides and of the covers of its ends has been inverted, the strip is now transformed in modulus and, therefore, ready to be anchored along the upper part of any industrial reflector or shade of any manufacturer working with standardized measurements, quite apart from the apparatus as described herein.

Once the assembly of the apparatus has been clearly understood, other details and characteristics of the same will be given during the course of the description which is given below, in which an explanation will be given of the more special details of the invention and, as well, of the means which may be employed for making it work.

These details are given as an example, making reference to a possible case of practical performance, although the invention is not exactly limited to those details which are explained herein and, therefore, this description should be considered as being a guide and without any limitations whatsoever.

A more detailed idea of the invention is furnished by the following description in which reference is made to the illustrative drawings accompanying this report and in which, in a schematic fashion and only by way of example, the more important details of the invention are shown.

In these drawings reference marks are used for indicating parts, groups or pieces which correspond in the different views shown, whose parts, detail and organization are defined in a specific fashion during the course of the report.

Figure 4:
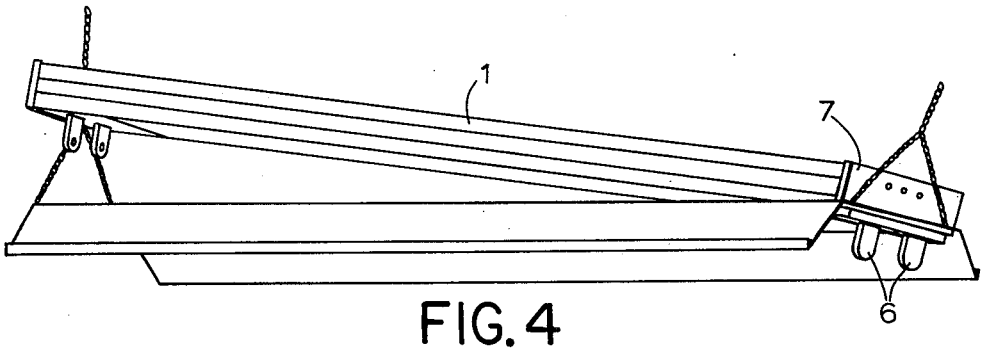

In FIG. 4 one can see the modulus, anchoring it on a universal industrial shade.

Figure 5:
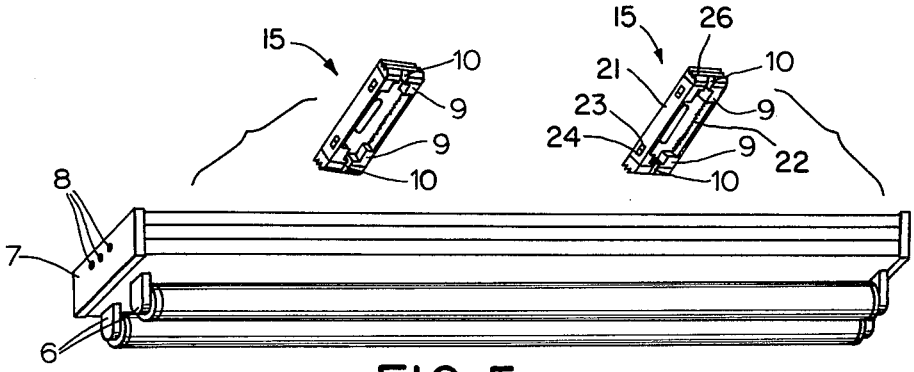

FIG. 5 is a perspective of the apparatus ready for being anchored on the ceiling by means of the miniracks presented outside the group.

FIGS. 6A through 6D represent the way in which the apparatus described herein is anchored to the ceiling, when used as a strip fixed to the ceiling.

Figure 7A:
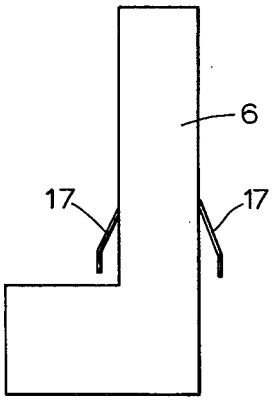
Figure 7B:
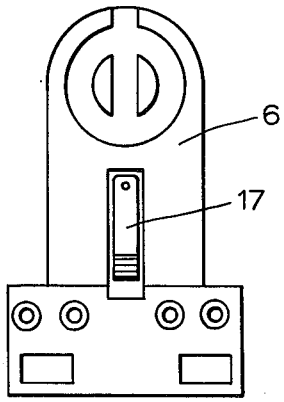

FIGS. 7A and 7B represent a standard measurement lamp holder which can be used in the strip apparatus.

FIGS. 8A and 8B illustrate a starter holder support capable of receiving any starter holder on the market having standardized measurements.

FIGS. 9A and 9B represent the covers of the apparatus with the three holes for passing wires through.

FIGS. 10A and 10B illustrate the lamp holder support which we call interior slides, and which can accept any lamp holder having standardized measurements existing on the market.

FIG. 11 is a pair of special miniracks for which contacts are foreseen.

Figure 12:
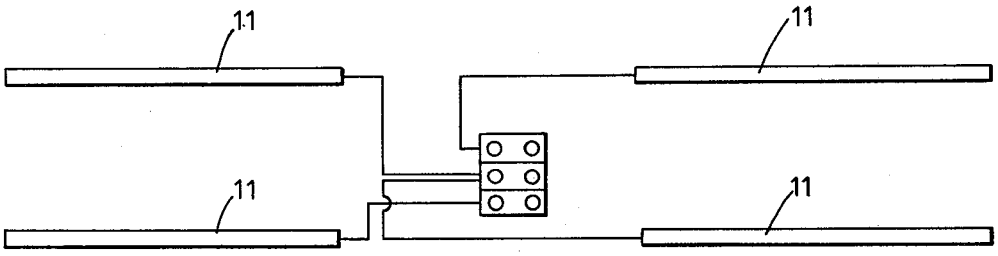

FIG. 12 represents the four longitudinal small plates which the shade of the strip possesses and, as well, the special current connection to the outlet plug.

Figure 13:
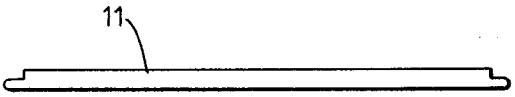

FIG. 13 is a drawing of one of the contacts.

Figure 14:
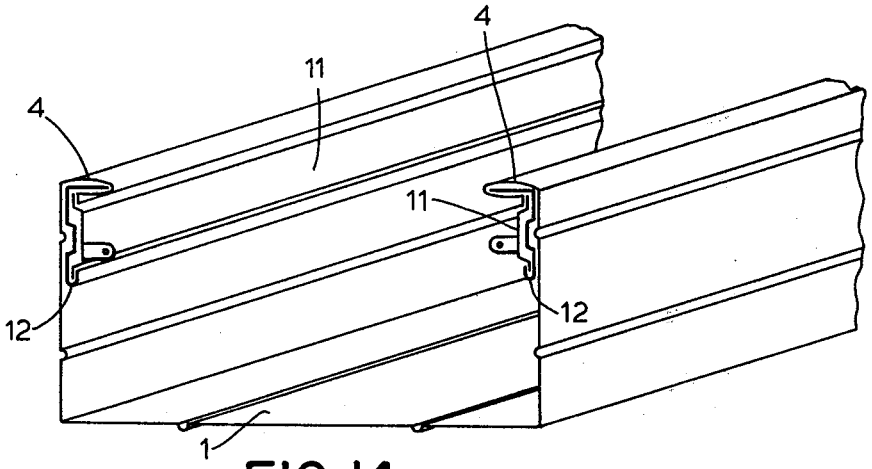

FIG. 14 shows how the shade contacts are placed in the same and, as well, the insulating support.

FIGS. 15A and 15B show different illustrations of the use of the apparatus.

Referring to the drawings, the channellike strip of the apparatus has been marked 1 and the slides 2 are slidably mounted thereon. These slides have flanges 3 which are suitably slidably disposed under the longitudinal flanges 4 of the strip 1. The strip 1 has a conventional starter holder 13 mounted thereon for receiving the tube starters 14.

These slides 2 are capable of receiving on some seats 5 any lamp holder 6 which is standard on the market, which holders carry some flat springs 17 which are anchored to the slides 2.

Figure 1:
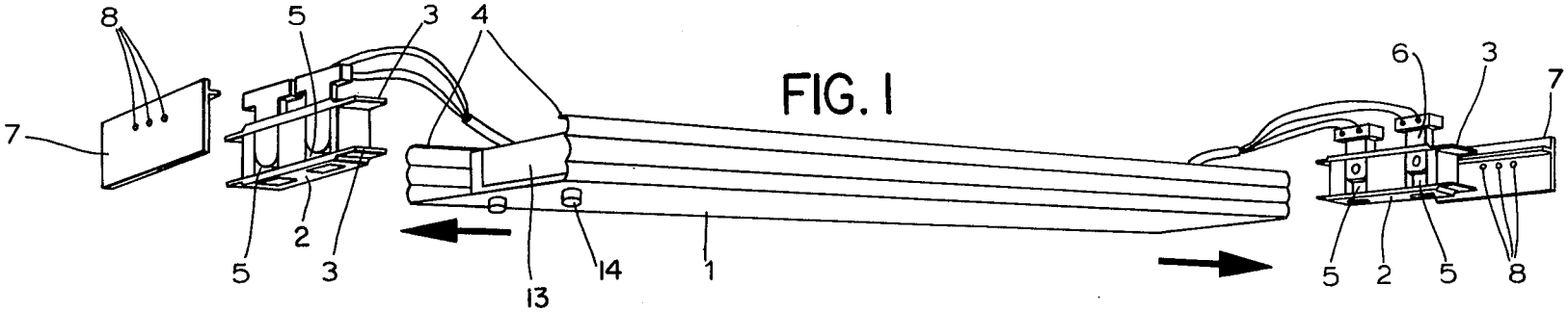
FIG. 1 represents a mounting perspective of the apparatus explained herein, showing the strip and the slides on which the lamp holders are mounted and, as well, the covers of the strip.
Figure 2:
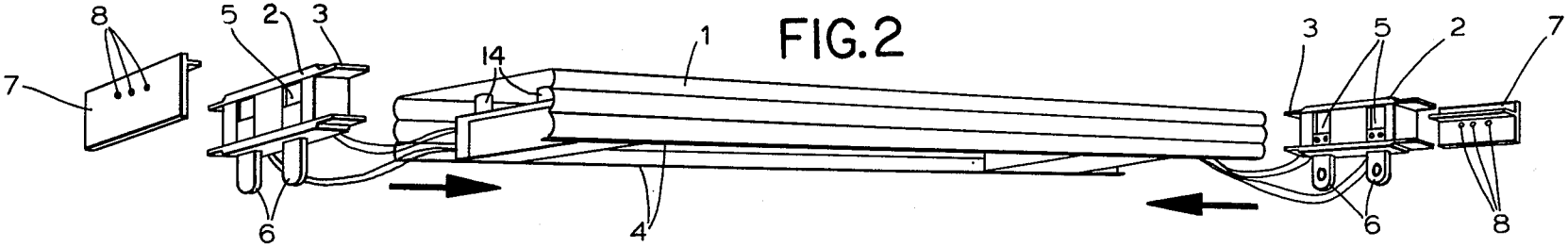
FIG. 2 is another perspective view of the mounting of the apparatus with the special detail of showing the reversible character of the slides and the covers.
Figure 3:
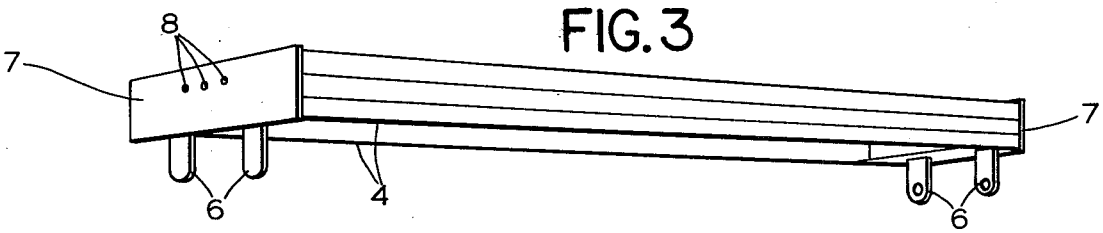
FIG. 3 is a perspective of the apparatus when it is going to be used as a modulus or casing for industrial apparatus.

It is observed that the end covers 7 which laterally close the strip possess holes 8 for passing the wires through when the invention is used as a modulus for industrial equipment or apparatus, such holes not being usable in the case of using the strip apparatus fixed to the ceiling or wall. The strip 1 as appearing in FIGS. 1 and 2 is identical except that the strip is represented in reversed positions. That is, the channellike strip in FIG. 1 opens upwardly, and receives the slides 2 in the ends thereof with the lampholders being illustrated as projecting only part way down into the slides for purposes of illustration. However, in utilization, these holders are slidably inserted all the way down into the slides so as to project below the strip to permit utilization in the manner illustrated in FIG. 5. FIG. 2 illustrates the reverse mounting of the strip so that same opens downwardly, and the slides again are received in the ends of the strip but the lampholders are illustrated fully inserted into the slides so that they thus project downwardly and are positioned below the strip as illustrated in FIGS. 3 and 4.

To permit mounting of the strip 1 directly on a ceiling or wall, same is mounted in the position of FIG. 1 and, for this purpose, the ceiling or wall is provided with a pair of miniracks 15 mounted thereon and positioned for releasable engagement with the strip 1, as illustrated in detail in FIGS. 5, 6 and 11.

These miniracks 15 comprise a U-shaped mounting or base 21 having a pair of insulated lugs 9 slidably supported therein and projecting outwardly from opposite ends thereof. These lugs are resiliently urged outwardly in opposite directions by intermediate springs 22. The opposite sides of the lugs have projections 23 slidably guided in slots 24 formed in the sides of the mounting 21 which limits the outward extension of the lugs. These lugs also have a toothed or camlike profile 25 formed on the outer end surface thereof.

The miniracks (FIG. 5 and FIG. 11) carry on their insulating lugs 9 some electrical contacts 10 which are those which carry out the union with the longitudinal electrical contacts 11 which the strip 1 possesses. These longitudinal contacts 11 rest like a slide on a plastic profile 12 which is fixed to the inside of flanges 4 of the strip 1, whereby these elongated contacts 11 extend longitudinally of the strip and are thus positioned to receive electric current from the contacts 10.

The special connection of the longitudinal contacts 11 which is to be observed in FIG. 12, permits, once the miniracks have been placed on the ceiling or wall, a proper electrical connection so that phase with phase and ground with ground always coincide. The strip 1, when in an upwardly opening position, can be easily mounted on or removed from the miniracks by following the manipulations illustrated in FIGS. 6A and 6B. To mount the strip 1 on the miniracks, same is pushed upwardly toward the miniracks as mounted on the ceiling so that the opposite side flanges 4 of the strip 1 cammingly engage the toothed or profiled surfaces 25 formed on the ends of the projecting lugs 9. This causes the lugs 9 to be pushed inwardly in opposition to the urging of the springs 22, which inward displacement is guided by means of the projections 23 sliding along the slots 24 formed in the mounting 21. When the strip is pushed fully upwardly into its desired position as illustrated in FIG. 6B, the springs 22 urge the lugs 9 outwardly so that the toothed or profiled ends 25 thus project under and lockingly hold the flanges 4 of the strip. At the same time, the electrical contacts 10 on the miniracks engage the contact 11 on the strip.

When removal of the lighting strip is desired, same is accomplished by following the procedure illustrated in FIGS. 6C and 6D. The strip 1 is pushed sidewardly as illustrated in FIGS. 6C, thereby pushing in one of the lugs 9 as mounted on one side of the miniracks, resulting in the lugs on the opposite sides of the strip being disengaged from the respective flange. The strip is then tilted downwardly about one edge as illustrated in FIG. 6D, following which the remaining side can be easily released from the lugs so as to totally disconnect the strip from the miniracks.

For when the equipment can be used as a modulus or casing, these longitudinal small plates are connected to a three element plug, automatic from which one can draw out three wires through the holes 8 which the cover 7 possesses for connecting to the point of light.

In FIGS. 15A and 15B, we show, just for guidance purposes, different possibilities of application, and which, as can be seen present different formats.

After having inspected the drawings and read the foregoing description, it will be easily understood that the new concept provides a simple and effective construction capable of being put into practice with great ease, assuring the obtention of a relatively cheap manufacturing process and above all a notable simplification in mounting and maintenance, obtaining great advantages in the saving of time.

Although the system has been described in accordance with an important application of the invention, this should not be understood as being subject to limitations as, on the contrary, when it is used fixed to the ceiling it admits numerous forms of use, it being capable of being used, for example, in decorative apparatus, provided with diffusers of plastic, glass, lattice or other models deemed to be convenient, with the shape and sizes that are considered suitable, and with an unlimited number of tubes; in all cases subject to the considered opinion of the manufacturer-user of the item described in this application.

It is repeated that, in the object which constitutes this model, it will be possible to introduce all those modifications of detail which circumstances and practice might render advisable, providing that the essential characteristics of the invention described do not suffer any alteration.

Having made a description of the invention in question and which, it is hereby declared, is not divulged or practiced in Spain, the following claims are stated hereunder:

1. An apparatus for fluorescent lighting, comprising an elongated channellike housing having a pair of side flanges, said housing being adapted to be disposed in a first orientation wherein same opens upwardly for mounting on a ceiling, said housing being adapted to be mounted in a second orientation wherein it opens downwardly, a pair of lampholders slidably disposed within the housing adjacent the opposite ends thereof, a pair of end covers receivable within the opposite ends of said housing, said lampholders and said covers coacting with the opposite side flanges for holding the covers and the lampholders on the housing, said covers and said lampholders being inverted relative to said housing when the latter is converted for use from said first orientation to said second orientation and vice versa, and a pair of mounting racks adapted to be secured to the ceiling for releasably supporting said housing when the latter is in said first orientation, each mounting rack including a pair of insulated lugs spring urged outwardly in opposite directions and having camming means on the outer ends thereof adapted for engagement with the flanges of said housing, each of said lugs having electrical contact means associated therewith and positioned for engaging a cooperating electrical contact means mounted on the inside of the flanges of said housing.

* * * * *